United States Patent [19]

Langner

[11] Patent Number: 4,798,158

[45] Date of Patent: Jan. 17, 1989

[54] SEISMIC FLOAT RECOVERY SYSTEM

[75] Inventor: Carl G. Langner, Spring, Tex.

[73] Assignee: Shell Oil Company, Houston, Tex.

[21] Appl. No.: 68,813

[22] Filed: Jun. 30, 1987

Related U.S. Application Data

[63] Continuation of Ser. No. 810,621, Dec. 19, 1985, abandoned.

[51] Int. Cl.[4] ..... B63B 21/16

[52] U.S. Cl. ..... 114/253; 441/25; 414/137.7

[58] Field of Search ..... 441/21-25, 441/27; 114/242-245, 251, 253, 254, 259, 268, 51, 322, 362, 365, 366, 377, 379, 375; 414/137, 138, 140; 212/193; 367/14, 16; 181/118, 120; 405/158, 166, 173; 244/1 TD; 73/178 A

[56] References Cited

U.S. PATENT DOCUMENTS

| | | | |
|---|---|---|---|
| 1,270,903 | 7/1918 | Weismandel | 114/375 |
| 2,896,564 | 7/1959 | Wright | 114/375 |
| 2,939,657 | 6/1960 | Westcott | 114/261 |
| 3,303,945 | 2/1967 | Hubbard | 114/375 |
| 3,448,712 | 6/1969 | Lehmann | 114/44 |
| 3,568,623 | 3/1971 | Gustavson | 114/253 |
| 3,793,623 | 2/1974 | Gongwer | 114/253 |
| 4,276,850 | 7/1981 | Valencia | 114/230 |
| 4,304,189 | 12/1981 | Wright | 244/1 |
| 4,455,961 | 6/1984 | Hansen | 114/253 |
| 4,480,577 | 11/1984 | Waypaver | 114/253 |
| 4,516,517 | 5/1985 | Ayers | 114/253 |

FOREIGN PATENT DOCUMENTS

| | | | |
|---|---|---|---|
| 2346294 | 9/1973 | Fed. Rep. of Germany | 114/253 |

*Primary Examiner*—Joseph F. Peters, Jr.
*Assistant Examiner*—Clifford T. Bartz

[57] ABSTRACT

A method and apparatus are provided for positioning and securing a seismic float alongside a tow vessel, utilizing a docking cone to secure one end of the float and to raise that end of the float above the water, thereby submersing the other end of the float beneath the water, and thereby damping out movements of the float with wave action. Having so positioned and secured the float, a saddle or other attachment means may then be lowered onto the float for retrieval of the float to onboard the tow vessel.

3 Claims, 1 Drawing Sheet

SEISMIC FLOAT RECOVERY SYSTEM

This is a continuation of application Ser. No. 810,621 filed Dec. 19, 1985, now abandoned.

BACKGROUND OF THE INVENTION

It is difficult to attach lifting lines to a seismic float, which is part of a seismic subarray, while the float is alongside a tow vessel, due to differential motions between the float and the tow vessel. It is considered quite difficult and dangerous for men to reach over the side with grapples to try to put lines on the seismic float, particularly when the tow vessel is much larger than the seismic float.

One conventional way of attaching lines to the seismic float is to leave "pigtails" trailing from the seismic float. These pigtails are captured using poles and brought onboard the tow vessel for attachment to lift lines. However, this procedure is very cumbersome for recovering, for example, from a 300-foot long tow vessel, a seismic float which may be up to 60 feet long, weigh up to 25,000 lbs., and have attached gear such as seismic guns and umbilical cables which are subject to entanglement. Accordingly, considering both the size, unwieldy dimensions, and motions of a seismic float in the water, it is desirable to have a recovery system which avoids the manifest problems of the art.

Applicant is not aware of any prior references which, in his judgment as one skilled in the art of seismic floats, would anticipate or render obvious the novel recovery method and apparatus of the invention. U.S. patent application Ser. No. 516,158 filed July 21, 1983, now U.S. Pat. No. 4,516,517 issued May 14, 1985 and having a common assignee, is relevant to the present invention.

SUMMARY OF THE INVENTION

The primary purpose of the present invention is to provide a recovery system for lifting a towed body onboard a towing vessel, which system is capable of handling a relatively cumbersome floating body which may have attached gear subject to entanglement, and which system is orderly, relatively simple in use, and free of malfunctioning.

Accordingly, there is provided a method for positioning a towable body floating alongside a tow vessel for retrieval to onboard the tow vessel, including raising the front end of the towable body beside the tow vessel, and allowing the rear end of the towable body to submerge beneath the water, thereby damping up and down movement of the towable body with wave action. Preferably, the forward end of the towable body is secured to a docking means which is rigidly affixed to the tow vessel. More preferably, the docking means is a cone configured to mate with the forward end of the towable body, and connection means such as a seismic umbilical cable passes from the tow vessel through the cone to the forward end of the towable body, and the forward end of the towable body is secured into the cone by pulling with connection means. Also more preferably, the connection means is strengthened over a short distance from the towable body, and the docking means contains traction means which engage this strengthened section of the connection means to secure the towable body into the docking means. There is also provided an apparatus for positioning a towable body floating alongside a tow vessel for retrieval to onboard the tow vessel, including docking means rigidly affixed to the tow vessel, means for attaching the front end of the towable body to the docking means, and means for elevating the docking means to raise the front end and submerse the rear end of the towable body. Preferably, the docking means is a cone configured to mate with the forward end of the towable body, and connection means passes from the tow vessel through the cone to the forward end of the towable body, and the forward end of the towable body is securable to the cone by pulling with the connection means. Also more preferably, the docking means contains traction means which engage a locally strengthened section of the connection means to secure the towable body to the docking means. Most preferably, the towable body is a seismic float of a seismic subarray and the connection means is a seismic umbilical cable.

Other purposes, advantages and features of the invention will be apparent to one skilled in the art upon review of the following.

DESCRIPTION OF PREFERRED EMBODIMENTS

Figure 1:
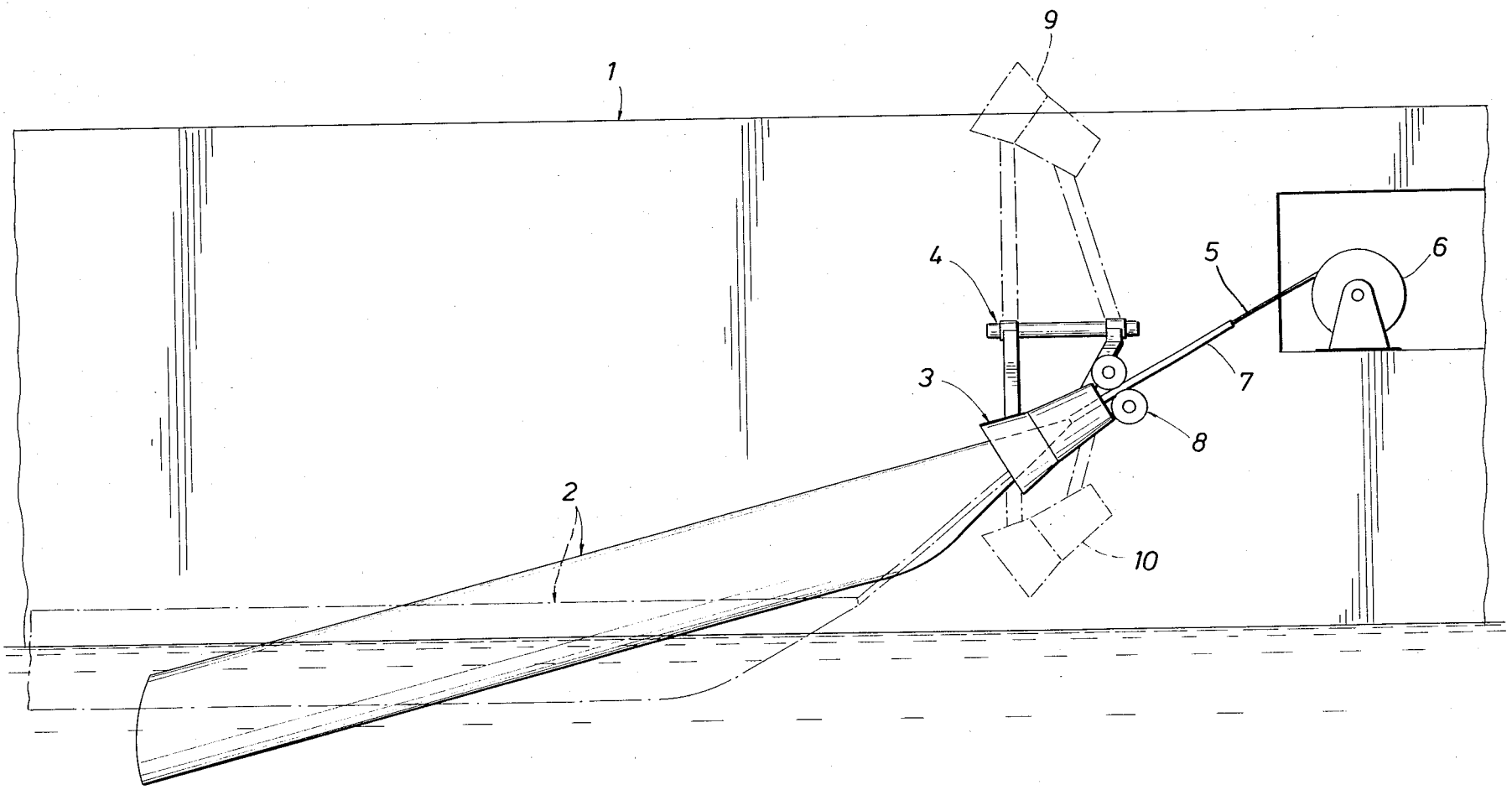
FIG. 1 discloses a seismic float in a partially recovered mode suspended alongside a tow vessel.

As shown in FIG. 1, a tow vessel 1 which is either underway or sitting motionless, has a towable body 2 (such as a seismic float of a seismic subarray) which is connected to vessel 1 via an umbilical cable 5 which passes through a docking cone 3. The docking cone 3 itself is connected to vessel 1 by support arms 4 which may be either fixed or hinged to the vessel. Alternatively to a docking cone 3, other means may be used to secure float 2 to vessel 1 such as clamping means or other connection means well known to the art. As shown in phantom, prior to assuming an elevated position, the seismic float 2 rests alongside the tow vessel 1 on the surface of the water. Preferably, seismic float 2 is pulled in and secured to the docking cone by means of its umbilical cable 5, although other connecting means can be employed such as a chain, cable, rope, etc. The umbilical cable 5 is wound onto a winch 6 which controls the position of the seismic float 2. Winch 6 is used to bring the nose of the float 2 into proximity of the docking cone 3 in preparation for retrieving the float 2 onboard the tow vessel 1. To prevent breaking of the umbilical cable 5 as the seismic float 2 is lifted out of the water and secured to the docking cone 3, the umbilical 5 may be locally strengthened 7 over a short distance from the float 2. Traction means 8 may be employed to grip and pull in the strengthened umbilical cable 7 as necessary to secure the seismic float 2 to the docking cone 3. Traction means 8, if mounted on the docking cone 3, would allow direct displacement-controlled movement of the float 2 to the docking cone 3 throughout the pull-in operation, thus avoiding impact loadings such as may arise due to the elasticity of the umbilical and other structures if the ship-board winch 6 alone were used to perform the pull-in operation.

When the docking cone 3 is not is use, it may be stowed in an upward position 9 as shown in phantom, and when it is initially deployed, to help recover a float 2, it may be stowed in a downward position 10 as also shown in phantom. Once the seismic float 2 is nudged into the docking cone, it may be elevated upward to carry the seismic float into the intermediate elevated position shown. In this position the rear end of the seismic float becomes immersed in the water and wave motion effects on the seismic float are damped, making it much easier to secure the seismic float which then acts much like a semisubmersible at this stage, to a latching saddle, such as shown in copending application Ser. No. 516,158 filed July 21, 1983, now U.S. Pat. No. 4,516,517 issued May 14, 1985 which is commonly assigned, or by other means such as cables or lines which are attachable to the seismic float.

This method and apparatus can obviously be used to lift and secure all forms of towed bodies, like submarines or remote-controlled submersible vehicles, from alongside or aft of the mother ship.

The foregoing description of the invention is merely intended to be explanatory thereof and various changes in the details of the described method and apparatus may be made within the scope of the appended claims without departing from the spirit of the invention.

What is claimed is:

1. A method for retrieving a seismic float from waves alongside a tow vessel to onboard the tow vessel, comprising:

providing a docking means rigidly affixed to the tow vessel, the docking means being a cone and a connection means passing from the tow vessel through the cone;

storing the cone in an upward position on the tow vessel, then rotating the cone around an axis not perpendicular to the axis of the cone to a downward position to receive the seismic float, and connecting the front end of the seismic float to the connection means;

rotating the around an axis not perpendicular to the axis of the cone to an intermediate position to elevate the front end of the seismic float beside the tow vessel for eventual retrieval; and thereby allowing the rear end of the seismic float to submerse beneath the water, and damping up and down movement of the seismic float with wave action.

2. The method of claim 1 wherein the connection means is locally strengthened over a short distance from the seismic float to prevent breakage during the final pull into the docking means.

3. The method of claim 1 wherein the docking means contains traction means for gripping and pulling the connection means, thereby allowing the seismic float to be pulled in and secured to the docking means in a controllable manner.

* * * * *